US011661818B2

(12) United States Patent
Alluhaydan et al.

(10) Patent No.: US 11,661,818 B2
(45) Date of Patent: May 30, 2023

(54) SYSTEM AND METHOD OF LINER AND TUBING INSTALLATIONS WITH REVERSE WIPER PLUG

(71) Applicant: Saudi Arabian Oil Company, Dhahran (SA)

(72) Inventors: Abdulaziz Sulaiman Alluhaydan, Udhailiyah (SA); Ahmed Mohammed Alghuryafi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/445,145

(22) Filed: Aug. 16, 2021

(65) Prior Publication Data

US 2023/0048084 A1 Feb. 16, 2023

(51) Int. Cl.

| | |
|---|---|
| ***E21B 33/16*** | (2006.01) |
| ***E21B 37/02*** | (2006.01) |
| ***E21B 37/10*** | (2006.01) |

(52) U.S. Cl.

CPC ..... *E21B 33/16* (2013.01); *E21B 37/02* (2013.01); *E21B 37/10* (2013.01)

(58) Field of Classification Search

CPC ..... E21B 37/02; E21B 37/04; E21B 37/045; E21B 37/10; E21B 33/16

See application file for complete search history.

(56) References Cited

U.S. PATENT DOCUMENTS

| | | | | |
|---|---|---|---|---|
| 5,803,173 | A | 9/1998 | Fraser, III et al. | |
| 6,527,057 | B2 | 3/2003 | Fraser, III et al. | |
| 6,631,763 | B1 * | 10/2003 | Self | E21B 43/129 166/387 |
| 6,712,152 | B1 | 3/2004 | Yokley et al. | |
| 6,799,638 | B2 | 10/2004 | Butterfield, Jr. | |
| 9,080,422 | B2 | 7/2015 | Melenyzer | |
| 9,845,665 | B2 | 12/2017 | De Clute-Melancon | |
| 10,408,015 | B2 | 9/2019 | Adam | |
| 10,472,927 | B2 | 11/2019 | Marcin et al. | |
| 10,774,613 | B2 | 9/2020 | Gaspard et al. | |
| 10,907,428 | B2 | 2/2021 | Luke et al. | |
| 2008/0164031 | A1 * | 7/2008 | Howell | E21B 33/16 166/305.1 |
| 2012/0118577 | A1 * | 5/2012 | Trahan | E21B 21/103 166/173 |
| 2013/0213655 | A1 * | 8/2013 | Martinez | E21B 43/114 166/55 |
| 2016/0123116 | A1 * | 5/2016 | Randle | E21B 17/006 166/243 |

* cited by examiner

*Primary Examiner* — David Carroll
(74) *Attorney, Agent, or Firm* — Leason Ellis LLP

(57) ABSTRACT

A method of removing dope from a tubing system in a wellbore includes the step of, prior to setting a production packer, reverse circulating fluid within a tubing-casing annulus (TCA) so that is flows from the tubing-casing annulus into a first tubing and propels at least one wiper plug within the first tubing in an uphole direction, thereby wiping the inside of the first tubing and removing excess dope.

18 Claims, 3 Drawing Sheets

SYSTEM AND METHOD OF LINER AND TUBING INSTALLATIONS WITH REVERSE WIPER PLUG

TECHNICAL FIELD

The present disclosure is directed to installation of pipe in a wellbore and more particularly, relates to the use of wiper plugs that are deployed in a reverse direction compared to conventional wiper plugs in that the wiper plugs are deployed from the bottom-up (in reverse direction) as opposed to the conventional method of deploying the plugs from the top down.

BACKGROUND

In conventional installation, pipe that is utilized to case wellbores is cemented into the wellbore to anchor the well pipe. This type of pipe is most commonly referred to as being "casing". The installation includes a cementing step which is initiated by pumping a cement slurry down into the casing from the well surface. The cement slurry flows out from the bottom of the casing and returns upwardly toward the surface in an annulus formed between the casing and the surrounding wellbore.

More particularly, after formation of the wellbore, casing or steel pipe is run into the well. After this step, a cementing head is fixed to the top of the casing or drill pipe to receive cement slurry from pumps. The cementing process generally includes the use of two wiper plugs, or cementing plugs, that sweep the inside of the casing and prevent mixing between the cement slurry and drilling fluids. These two wiper plugs are referred to as being the bottom plug and the top plug. The role of the bottom plug is to keep the drilling fluids from mixing with the cement slurry. The bottom plug is introduced into the well and cement slurry is pumped into the well behind it. The bottom plug descends along the wellbore and is then caught just above the bottom of the wellbore by a float collar, which functions as a one-way valve allowing the cement slurry to enter the well. Then the pressure on the cement being pumped into the well is increased until a diaphragm is broken within the bottom plug, permitting the slurry to flow through it and up the outside of the casing string.

This is the action that causes the slurry to return upwardly toward the surface in an annulus formed between the casing the surrounding wellbore. After the proper volume of cement is pumped into the well, a top plug is pumped into the casing pushing the remaining slurry through the bottom plug. Once the top plug reaches the bottom plug, the pumps are turned off, and the cement is allowed to set.

As mentioned, wiper plugs are used to provide mechanical separation between two fluids which have different properties and are deployed with wiper fins protruding upwards (opposite the fluid path) allowing better wiping action. The conventional way to use casing/liner/drill pipe wiper plugs is to have them deployed either from the surface through a housing device (cement head) or they can be simply dropped by hand inside the drill pipe or casings depending on the size. Larger wiper plugs are heavier and usually need mechanical hoisting systems to move them, if cement heads are not used. For liners, the conventional method is to install the wiper plug in a sub with the liner hanger assembly which is connected to a drill pipe as a means of positioning the liner unto the specified depth.

SUMMARY

The present disclosure sets forth a method of removing dope from a tubing system in a wellbore that includes a production casing. The method includes the steps of:

installing at least one wiper plug in a carrier;

advancing the carrier within a first tubing of the wellbore in a downhole direction to a location below a production packer;

releasing the at least one wiper plug from the carrier;

prior to setting the production packer, fluid within a tubing-casing annulus that is located between the production casing the first tubing is reverse circulated so that is flows from the tubing-casing annulus into an inside of the first tubing and propels the at least one wiper plug within the first tubing in an uphole direction, thereby wiping the inside of the first tubing and removing excess dope.

In another aspect, the present disclosure sets forth a wiper plug for removing dope from a tubing system in a wellbore. The wiper plug is defined by a wiper plug body having a first end and an opposite second end. The wiper plug body further has a plurality of plug fins that protrude outwardly from the wiper plug body and are angled downwardly toward the second end. The at least one wiper plug is configured for positioning in the wellbore such that the first end faces uphole and the second end faces downhole.

BRIEF DESCRIPTION OF THE DRAWING FIGURES

DETAILED DESCRIPTION OF CERTAIN EMBODIMENTS

Figure 1:
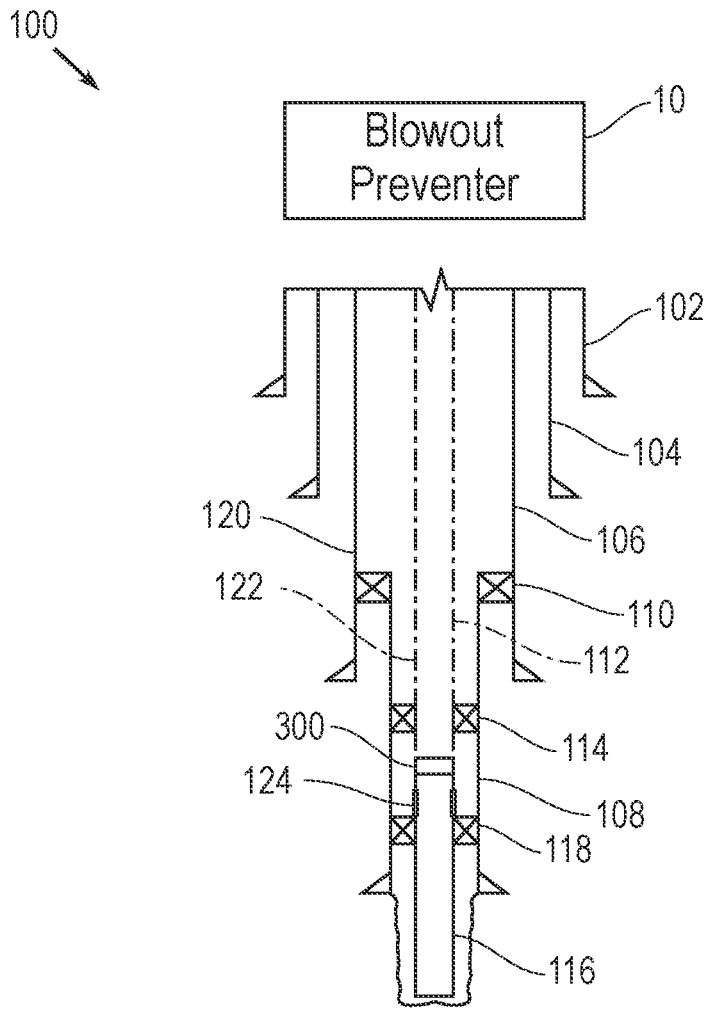
FIG. 1 is a cross-sectional schematic of a wellbore that includes a production packer.

FIG. 1 illustrates a conventional a wellbore (well) 100 completed with a production packer with a Polished Bore Receptacle (PBR)and a seal in assembly will be appreciated that the illustrated wellbore 100 is exemplary in nature and the wellbore 100 can have other types of constructions.

The wellbore 100 includes a number of different casings including a surface casing 102. As is known, the surface casing 102 is a pipe string with a large diameter that is the first one to be set in a well. It is a low-pressure pipe that is cemented first in the well to act as a protective shield to preserve the water aquifers in the region. The wellbore 100 further includes an intermediate casing 104 that is the casing which is generally set in place before production casing (discussed below) and after the surface casing 102 to provide protection against the abnormally pressured of weak formations.

Production casing 106 is the final casing run and is typically hung from a casing hanger or slips on the surface. In conventional wells, the production casing is generally set below the target zone, but it can stop above the target zone if it is desirable to change drilling fluid for penetrating the target zone.

A liner 108 is provided and is located inside the production casing 106. As is known, a liner is a casing string that does not extend to the top of wellbore but instead in anchored or suspended from inside the bottom of the previous casing string. Liner 108 is suspended using a liner hanger 110. Liner hanger 110 is a device that is used to attach or hang a liner (e.g., liner 108) from the internal wall of the previous casing string (e.g., production casing 106).

The wellbore 100 includes a number of components that form a production string.

For example, production tubing 112 is run into the drilled well after the casing is run and cemented in place or if the well is completed with an alternative lower completion method. Production tubing protects wellbore casing from wear, tear, corrosion, and deposition of by-products, such as sand/silt, paraffins, asphaltenes and wellbore hydrocarbons. Along with other components that constitute the production string, it provides a continuous bore from the production zone to the wellhead through which oil, gas, and/or water can be produced. Tubing thus transports the target zone fluids from deep in the well to the surface (the third phase of the wellbore). Tubing naturally has a small diameter than casing.

A production packer 114 is part of the production string and as is known, a production packer is a standard component of the completion hardware of oil, gas or water wells used to provide a seal between the outside of the production tubing and the inside of the casing, liner, or wellbore wall. In FIG. 1, the production packer 114 is located between the liner 108 and the production tubing 112.

The production string further includes a production liner 116 that is axially arranged relative to the production tubing 112. The production liner 116 is suspended using a production liner hanger 118 that serves to hang the production liner 116 from the surrounding liner 108.

As is also known, the annulus of the well is any void between any piping, tubing or casing and the piping, tubing or casing immediately surrounding it. In FIG. 1, a tubing-casing annulus (TCA) 120 is provided and is located between the production casing 106 and the production tubing 112.

The production string also includes a polished bore receptacle (PBR) 122 that, as is known, is a device that is honed with the internal diameter of the sealing surface. It is mainly used in tieback liner and for landing a production tubing seal assembly. It is installed in a liner string to handle the liner-while-drilling service operations. A tie-back receptacle 124 is shown in FIG. 1.

As is known, the upper completion refers to all of the components from the bottom of the production tubing 112 upwards. Proper design of this completion string is essential to ensure that the well can flow properly given the reservoir conditions and to permit any operations as are deemed necessary for enhancing production and safety.

One of the contaminants in the wellbore is pipe dope. Pipe dope is used to seal tubing joints, minimize thread erosion and enhance the galling resistance of the threads. Pipe dope is thus a pipe thread sealant. The primary function of thread compounds is to provide sealability, galling resistance, and uniform frictional characteristics while lubricating the thread pattern of drill pipe during make up. Pickle treatments are commonly conducted to remove various contaminants, including pipe dope, from the wellbore. A pickle solution is a complex blend of solvents that are selected to be effective at dissolving and dispersing pipe dope. The pickle treatment involves circulating the pickle solution with respect to the surface to be treated (i.e., inner surface of the liner) so that the pickle solution separates the material (e.g., pipe dope) from the tubing inner surface for removal with the material being dispersed in the pickle solution. The present disclosure provides a mechanical alternative and/or an accessory to the use of pickle solutions for pipe dope removal enhancement.

As discussed herein, the present system and method utilizes a wiper plug 200 to remove excess dope after running the tubing and accessories. As described herein, the wiper plug 200 operates in a manner that is opposite to the conventional use of wiper plugs to displace cement as part of the cementing process. The wiper plug 200 thus provides a mechanical means for removing the pipe dope.

As is shown in FIG. 1, a wiper plug carrier in the form of a carrier sub 300 is provided and configured for delivering the wiper plug to the downhole location. The carrier sub 300 can have any number of conventional designs.

The carrier sub 300 is installed in the tail pipe below the production packer 114 prior to setting the production packer 114. This installation results in the reversal of the fluid out from the TCA 120 through the production tubing 112 to remove excess pipe dope, if any. This is highly recommended to reduce rigless intervention and additional cleanout runs after rig release.

Figure 3:
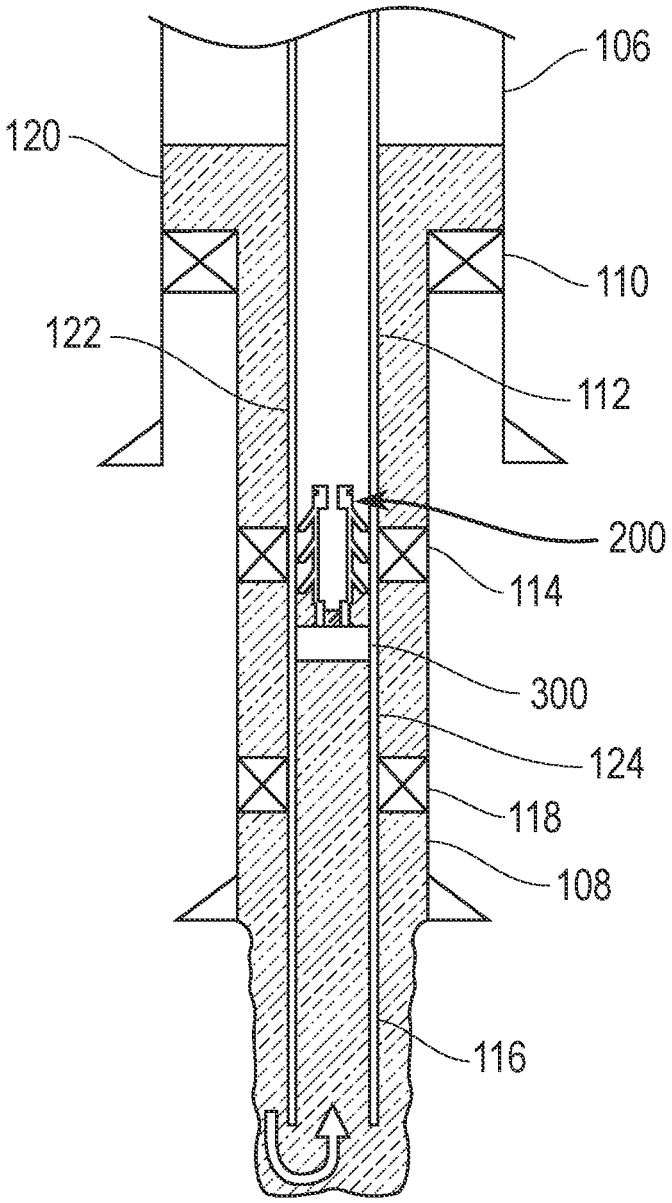
FIG. 3 is another cross-sectional view of the wiper plug showing the fluid flowpath.

In accordance with the present disclosure, the system and method utilize wiper plugs 200 that are deployed in a reverse direction in that the wiper plugs 200 are deployed from the bottom-up when compared to the conventional method of deploying the wiper plugs from the top down. The orientation of the wiper plugs 200 allows for the wiping action to be performed on the direction of the fluid flow which will be reversed, as well, from the annulus 120 to inside the production tubing 112. In other words, completely opposite to the conventional flow direction in which non-reservoir fluid flows down the production tubing and then flows into and up the annulus, the disclosed system and method run in reverse in that fluid runs through the annulus and then into and up the production tubing. FIG. 3 shows the reverse flow of fluid that propels the wiper plug in an upward direction. In FIG. 3, the cross hatched area indicates the fluid that flows downward in the annulus 120 and then up the center of the production tubing 112. FIG. 3 also shows the carrier sub 300 from which the wiper plug is released. As described herein, under certain conditions, such as applied fluid pressure, the wiper plug is detached and released from the carrier sub 300.

However, the conventional method of installing the wiper plugs in a sub (such as the carrier sub 300), which is to be run downhole, is required as part of the disclosed method. There are multiple methods to release the wiper plug 200 from the wiper plug sub 300 including rupture disks (diaphragms) or shear pins allowing transfer of well hydraulic pressure above the sub 300 to release the wiper plug 200. After the wiper plug 200 is released and is thus free to move up within the production tubing, means of shutting the well through blowout preventers 10 are necessary to allow the fluid in the well's TCA 120 to be pumped into the production tubing 112 propelling the releasing wiper plug 200 up towards the surface before setting the production packer. FIG. 1 generally shows a blowout preventer 10 at the top of the wellbore 100. As is known, the blowout preventer 10 at the top of the well that which consists of multiple rams and valves to seal the wellbore 100; it may be closed to prevent uncontrolled flow of fluids.

Figure 2:
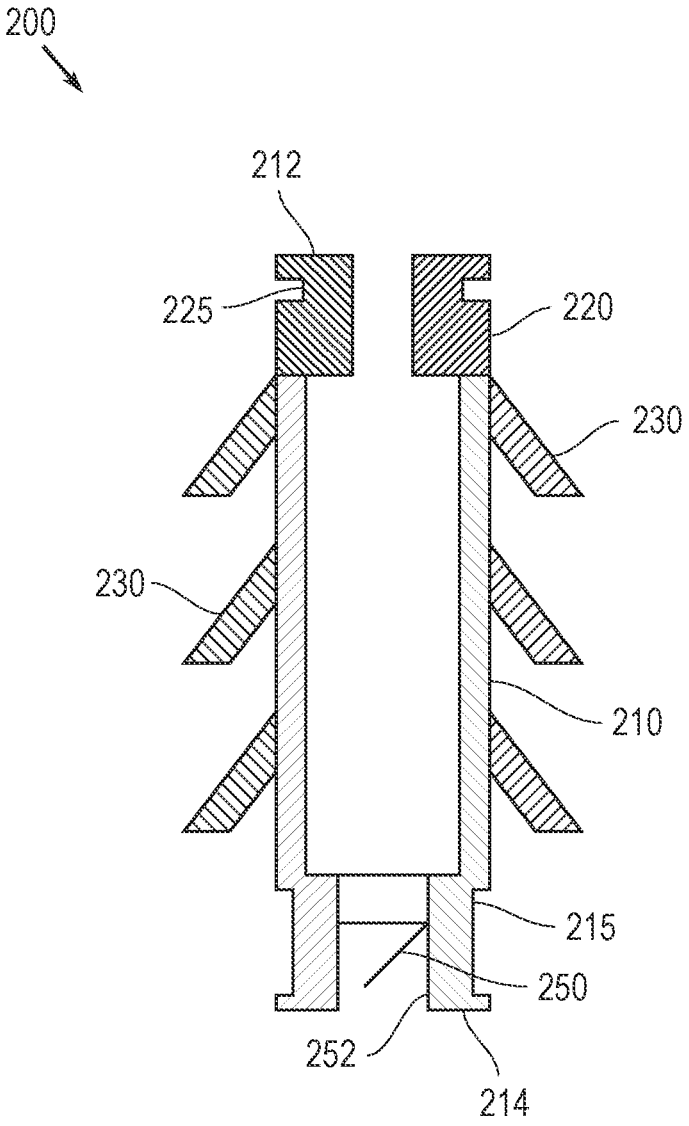
FIG. 2 is a cross-sectional view of a wiper plug for use in the system and method described herein.

FIG. 2 illustrates the wiper plug 200 for use in accordance with the system and method of the present disclosure. The wiper plug 200 is defined by a hollow plug body 210 that has a first end 212 and an opposite second end 214. As shown, both the first end 212 and the second end 214 are open. As described herein, during use and during installation of the wiper plug 200, the first end 212 is the end that faces the surface, while the second end 214 faces downhole. The plug body 210 is for insertion into the liner or tubing and is configured to travel up within the production tubing.

The first end 212 is in the form of a plug head 220 with a mechanical retrieving profile. More specifically, the plug head 220 is designed to permit mechanical retrieval of the wiper plug 200 in that the retrieval is necessary. In other words, the plug head 220 can be fished out of the liner or tubing by the plug head 220 by a mechanical method through a latch onto the plug head 220. In the illustrated embodiment, the plug head 220 has an annular groove 225 formed therein that allows for a mechanical latching action to occur. The annular groove 225 can be considered to be a female coupling feature that mates with a male coupling feature that is received within the female coupling feature (annular groove 225) for coupling the retrieval tool (instrument) to the wiper plug 200 for retrieval thereof from the liner. The plug head 220 can be formed of a different material compared to the material of the plug body 210. For example, the plug head 220 can be formed of a more resilient, more elastomeric material.

The plug head 220 has a center through hole which leads into the hollow interior of the plug body 210. This center through hole is thus coaxial with the hollow interior of the plug body 210. As shown, the through hole in the plug head 220 can have a diameter that is less than the diameter of the hollow interior of the plug body.

The plug body 210 includes a plurality of plug fins 230 that are formed along the plug body 210. Each plug fin 230 can be formed as an annular shaped fin that surrounds the plug head 220 at a location along the length of the plug body 210. As shown, the plug fins 230 are axially spaced apart from one another along the length of the plug body 210. In the illustrated embodiment, there are three plug fins 230 along the plug body 210; however, it will be understood that this is only exemplary in nature and there can be more or less plug fins 230 along the plug body 210.

The plug fins 230 are resilient so that they can flex and seat against the inner surface of the liner in a sealed manner. The plug fins 230 can be formed of a material that is different than the material of the plug body 210. For example, the plug fins 230 can be formed of rubber or similar material.

The plug fins 230 are formed so that they are angled downwards towards the second end 214. In other words, the wiper fins 230 protrude downwards (opposite the fluid path) allowing better wiping action. This wiper fin orientation is directly opposite to traditional wiper fin design in which the wiper fins protrude upwards.

These robust plug fins 230 enable removing pipe dope, cement, chemicals, scale and any debris properly and efficiently. It provides a simple and effective method to perform a final drift for the tubing as well.

The second end 214 of the plug body 210 is also configured to lock the plug body 210 in place. For example, the second end 214 can include a groove or thread 215 to lock the plug body 210 in place. As mentioned, the plug body 210 is hollow and is intended to be detachably coupled to the carrier sub 300. As mentioned, once released from the carrier sub 300, the wiper plug 200 can travel upwards in the liner or tubing. The groove or thread 215 can be considered to be a female coupling feature that mates with a complementary male coupling feature for coupling the plug body 210 to the carrier sub 300.

As shown, the plug fins 230 are located between the plug head 220 and the coupling feature at the second end 214.

In one another aspect, the wiper plug 200 also has a one-way valve 250 that is located at or near the second end 214. The one-way valve 250 can be a flapper float valve. The presence of the one-way valve 250 allows for the utilization of a hydraulic force through the one-way valve 250 in the event that intervention is required. The one-way valve 250 is formed within a valve seat 252 that communicates with the hollow interior of the plug body 210. The valve seat 252 has a center through hole that is coaxial with the hollow interior of the plug body 210. As shown, the through hole in the plug head 220 can have a diameter that is less than the diameter of the hollow interior of the plug body. In the closed position, the one-way valve 250 closes off this through hole at the second end 214. As shown, the size of the through hole of the plug head 220 can be different than the size of the through hole formed in the valve seat 252.

The one-way valve (flapper valve) 250 provides a barrier in case of well control situations. Although the primary release mechanism of the present system doesn't require any intervention, the emergency release mechanism is designed for simple slickline intervention to retrieve the wiper plug 200 if required. As shown in FIG. 2, the one-way valve 250 opens in a downward direction (i.e., a direction toward the second end 214) and therefore, normal fluid flow in the upward direction within the liner or tubing will not open the one-way valve 250 but instead will apply an upward force to the second end 214 to propel the wiper plug 200 upward within the liner. In an emergency event, a retrieval tool can be advanced within the liner or tubing and is accommodated by the one-way valve 250 and as mentioned, hydraulic force through the flapper one-way valve 250 can be utilized.

In accordance with the proposed disclosure, a mechanical means, in the form of the wiper plug 200, is utilized to remove the dope in the upper completion (or other target location). In the present application, wiper plugs cannot be pumped downwards since access must remain to the wellbore. Existing methods do not provide a mechanical means to remove pipe/tubing dope that impact wellbore accessibility and intervention. Utilizing the method described herein ensures removing the dope completely and enhance the accessibility. The proposed method reduces the time to clean the tubing by conventional means of displacing pickle fluid with limited flow rates. This reduces costs since the well accessibility is improved and time of rigless operations will be less. Accordingly, the present system and method introduce a new application for wiper plugs in the upper completion of wellbores to remove the dope in a mechanical manner.

Example

During rigless operation, wellbore accessibility issues are encountered while running the perforation dummy gun on tractors. This has mandated performing several cleanout coil tubing runs to ensure safe and clean wellbore accessibility to deploy perforation guns. Dope, cement, and metal debris were recovered during these interventions. The system and method disclosed herein have a potential to save the excessive additional rig time spent to ensure wellbore accessibility and rigless time to perform dedicated coil tubing cleanout runs. The saving can reach up to 150 days of rig time, 100 days or rigless time and $32 MM per year.

The described method provides an effective solution for the existing well accessibility issues encountered in extended reach wells that are completed with lower and upper completions. The conventional methods for completing the wells with such lower and upper completions does not contain any mechanical means to remove dope/debris. In contrast, the present system and method provide mechanical means in the form of the wiper plug 200 to remove dope/debris in these sections of the wellbore.

The present disclosure thus describes a new application for wiper plugs in upper completion to remove the dope in the production tubing mechanically as opposed to use of pickle fluid.

The present system and method reduces the time to clean the tubing 112 by conventional means of displacing pickle fluid with limited flow rates. This will reduce cost as the well accessibility will be improved and time of rigless operations will be less. Thus, the present disclosure provides a solution for increased utilization of wiper plug systems and reduces or eliminates the need to pickle tubing and improve wellbore accessibility in production packer completion system.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A method of removing dope from a tubing system in a wellbore that includes a production casing, the method comprising the steps of:

installing at least one wiper plug in a carrier;

advancing the carrier within a first tubing of the wellbore in a downhole direction to a location below a production packer;

releasing the at least one wiper plug from the carrier;

prior to setting the production packer, fluid within a tubing-casing annulus that is located between the production casing the first tubing is reverse circulated so that is flows from the tubing-casing annulus into an inside of the first tubing and propels the at least one wiper plug within the first tubing in an uphole direction, thereby wiping the inside of the first tubing and removing excess dope.

2. The method of claim 1, wherein the wellbore further includes a first liner and a first liner hanger for suspending the first liner from the production casing and the production packer is located between the first tubing and the first liner.

3. The method of claim 1, wherein the wellbore further includes a production liner that is in fluid communication with the first tubing and a production liner hanger for suspending the production liner from the first liner, the production liner hanger being downhole from the production packer.

4. The method of claim 1, wherein the carrier comprises a wiper plug submarine.

5. The method of claim 1, wherein the at least one wiper plug comprises a wiper plug body having a first end and an opposite second end, the wiper plug body further having a plurality of plug fins that protrude outwardly from the wiper plug body and are angled downwardly toward the second end, the at least one wiper plug being positioned within the first tubing such that the first end faces uphole and the second end faces downhole.

6. The method of claim 5, wherein the first end comprises a plug head that has a mechanical retrieval profile.

7. The method of claim 6, wherein the plug head has a groove formed therein.

8. The method of claim 6, wherein the plug head is formed of a material different than a material of the wiper plug body.

9. The method of claim 5, wherein the second end has one of a groove and threads formed along an outer surface of the wiper plug body.

10. The method of claim 5, wherein the first end comprises a plug head that has a mechanical retrieval profile formed along an outer surface thereof and the second end comprises an inner valve seat and a one-way valve is disposed within the valve seat and is configured to open in the downhole direction.

11. The method of claim 10, wherein a main interior of the wiper plug body is defined by a first width and a first bore through the plug head that enters into the main interior has a second width and a second bore through the inner valve seat that into the main interior has a third width, wherein the second width<first width; the second width<the third width and the first width>third width.

12. The method of claim 10, wherein the one-way valve comprises a flapper float valve.

13. The method of claim 5, wherein the plurality of plug fins comprises at least flexible plug fins formed in series along a length of the wiper plug body.

14. The method of claim 1, further including the step of shutting down the wellbore through a blowout preventer to allow pumping of the fluid within the tubing-casing annulus into the first tubing to propel the at least one wiper plug uphole towards a surface.

15. The method of claim 1 wherein the step of releasing the at least one wiper plug from the carrier comprises performing a wiper release action selected from the group of: rupturing a disk, breaking shear pins, shearing a ball seat that is integral to the wiper plug, thereby allowing transfer of well hydraulic pressure above the carrier to release the at least one wiper plug.

16. The method of claim 1, wherein the fluid is pumped from the tubing-casing annulus into the first tubing.

17. The method of claim 1, further including the step of: utilizing an emergency release mechanism to retrieve the at least one wiper plug using a slickline intervention.

18. The method of claim 1, wherein the at least one wiper plug comprises an upper wiper plug and a lower wiper plug.

* * * * *